US007273978B2

(12) United States Patent
Uhle

(10) Patent No.: US 7,273,978 B2
(45) Date of Patent: Sep. 25, 2007

(54) DEVICE AND METHOD FOR CHARACTERIZING A TONE SIGNAL

(75) Inventor: Christian Uhle, Ilmenau (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 197 days.

(21) Appl. No.: 11/124,306

(22) Filed: May 5, 2005

(65) Prior Publication Data

US 2005/0247185 A1 Nov. 10, 2005

Related U.S. Application Data

(60) Provisional application No. 60/568,883, filed on May 7, 2004.

(30) Foreign Application Priority Data

May 7, 2004 (DE) ..... 10 2004 022 659

(51) Int. Cl.
*G04B 13/00* (2006.01)
*G10H 7/00* (2006.01)
*A63H 5/00* (2006.01)

(52) U.S. Cl. ..... 84/609; 84/610; 84/634; 84/649; 84/650; 84/666

(58) Field of Classification Search ..... None
See application file for complete search history.

(56) References Cited

U.S. PATENT DOCUMENTS 6,121,532 A * 9/2000 Kay ..... 84/611
6,121,533 A * 9/2000 Kay ..... 84/616
6,326,538 B1 * 12/2001 Kay ..... 84/635
6,639,141 B2 * 10/2003 Kay ..... 84/609

(Continued)

FOREIGN PATENT DOCUMENTS

DE 101 57 454 11/2001

(Continued)

OTHER PUBLICATIONS

Coyle, et al. "A System for Machine Recognition of Music Patterns." IEEE Intl. Conf. on Acoustic Speech and Signal Processing, 1998.

(Continued)

*Primary Examiner*—Marlon Fletcher
(74) *Attorney, Agent, or Firm*—Michael A. Glenn; Glenn Patent Group

(57) ABSTRACT

For characterizing a tone signal a sequence of quantized entry times for each of at least two tone sources over time is provided on the basis of a quantization raster. Hereupon, a common period length underlying the at least two tone sources is determined using the sequences of entry times. Hereupon, the sequence of entry times is divided into respective sub-sequences, wherein a length of a sub-sequence is equal to the common period length. Finally, the sub-sequences for the first tone source are combined into a first combined sub-sequence and for the second tone source into a second combined sub-sequence, i.e. for example using a pattern histogram, in order to characterize the tone signal by the first combined sub-sequence and by the second combined sub-sequence, e.g. with regard to rhythm, speed or genre.

21 Claims, 3 Drawing Sheets

U.S. PATENT DOCUMENTS

| | | | | |
|---|---|---|---|---|
| 6,951,977 | B1 * | 10/2005 | Streitenberger et al. | 84/626 |
| 7,046,262 | B2 * | 5/2006 | Feng et al. | 345/691 |
| 7,096,186 | B2 * | 8/2006 | Funaki | 704/278 |
| 2004/0255758 | A1 | 12/2004 | Klefenz et al. | |

FOREIGN PATENT DOCUMENTS

| | | |
|---|---|---|
| WO | 02/11123 | 2/2002 |

OTHER PUBLICATIONS

Schroeter, T., et al. "From Raw Polyphonic Audio to Locating Recurring Themes." ISMIR. 2000.
Meudic, B. "Musical Pattern Extraction: from Repetition to Musical Structure" Proc. CMMR. 2003.
Meek, C., et al. "Thematic Extractor." ISMIR 2001.
Smith, L., et al. "Discovering Themes by Exact Pattern Matching." 2001.
Lartillot, O. "Perception-Based Musical Pattern Discovery." Proc. IFMC. 2003.
Brown, J. "Determination of the Meter of Musical Scores by Autocorrelation." J. of the Acoust. Soc. Of America, vol. 94., No. 4. 1993.
Meudic, B. "Automatic Meter Extraction from MIDI Files." Proc. JIM. 2002.
Goto, M. et al., "Real-time beat tracking for drumless audio signals: Chord change detection for musical decisions", Speech Communication, Elsevier Science Publishers, Amsterdam, NL, vol. 27, No. 3-4, Apr. 1999, pp. 3111-3335.
English Translation of the International Preliminary Report (IPER) for PCT/EP20005/004517.

* cited by examiner

DEVICE AND METHOD FOR CHARACTERIZING A TONE SIGNAL

CROSS-REFERENCE TO RELATED APPLICATION

This application claims the benefit of U.S. Provisional Patent Application No. 60/568,883 filed on May 7, 2004, and is incorporated herein by reference in its entirety.

FIELD OF THE INVENTION

The present invention relates to the analysis of tone signals and in particular to the analysis of tone signal for the purpose of classification and identification of tone signals in order to characterize the tone signals.

DESCRIPTION OF THE RELATED ART

The continuous development of digital distribution media for multimedia contents leads to a large plurality of offered data. For the human user the overview has long been exceeded. Thus, the textual description of data by metadata is increasingly important. Basically, the goal is not only to make text files but also e.g. musical files, video files and other information signal files searchable, wherein the same comfort as with common text databases is aimed at. One approach for this is the known MPEG 7 standard.

In particular in the analysis of audio signals, i.e. signals including music and/or language, the extraction of fingerprints is of great importance.

It is further desired to "enrich" audio data with metadata in order to retrieve metadata on the basis of a fingerprint, e.g. for a piece of music. The "fingerprint" should on the one hand be expressive and on the other hand as short and concise as possible. "Fingerprint" thus indicates a compressed information signal generated from a musical signal which does not contain the metadata but musical signal which does not contain the metadata but serves for a referencing to the metadata e.g. by searching in a database, e.g. in a system for the identification of audio material ("AudioID").

Usually, musical data consists of the overlaying of partial signals of individual sources. While there are relatively few individual sources in a piece of pop music, i.e. the singer, the guitar, the bass guitar, the drums and a keyboard, the number of sources for an orchestral piece may be very high. An orchestral piece and a pop music piece for example consist of an overlaying of the tones given off by the individual instruments. An orchestral piece or any musical piece, respectively, thus represents an overlaying of partial signals from individual sources, wherein the partial signals are tones generated by the individual instruments of the orchestra or pop music ensemble, respectively, and wherein the individual instruments are individual sources.

Alternatively, also groups of original sources may be interpreted as individual sources, so that at least two individual sources may be associated with a signal.

An analysis of a general information signal is illustrated in the following merely as an example with reference to the orchestra signal. The analysis of an orchestra signal may be performed in many ways. Thus, there may be the desire to recognize the individual instruments and to extract the individual signals of the instruments from the overall signal and if applicable convert the same into a musical notation, wherein the musical notation would function as "metadata". Further possibilities of the analysis are to extract a dominant rhythm, wherein a rhythm extraction is performed better on the basis of the percussion instruments than on the basis of the rather tone-giving instruments which are also referred to as harmonic sustained instruments. While percussion instruments typically include kettledrums, drums, rattles or other percussion instruments, harmonic sustained instruments are any other instruments, like for example violins, wind instruments, etc.

Further, all acoustic or synthetic sound generators are counted among the percussion instruments contributing to the rhythm section due to their sound characteristics (e.g. rhythm guitar).

Thus, it would for example be desired for the rhythm extraction of a piece of music only to extract percussive parts from the complete piece of music and to perform a rhythm recognition on the basis of these percussive parts without the rhythm recognition being "disturbed" by signals of the harmonic sustained instruments.

In the art, different possibilities exist to automatically extract different patterns from pieces of music or to detect the presence of patterns, respectively. In Coyle, E. J., Shmulevich, I., "A System for Machine Recognition of Music Patterns", IEEE Int. Conf. on Acoustic Speech, and Signal Processing, 1998, http://www2.mdanderson.org/app/ilya/Publications/icassp98mpr.pdf, melodic themes are searched for. To this end, a theme is given. Then a search is performed where the same occurs.

In Schroeter, T., Doraisamy, S., Rüger, S., "From Raw Polyphonic Audio to Locating Recurring Themes", ISMIR, 2000, http://ismir2000.ismir.net/posters/shroeter ruger.pdf, melodic themes in a transcribed representation of the musical signal are searched for. Again the theme is given and a search is performed where the same occurs.

According to the conventional structure of Western music, melodic fragments in contrast to the rhythmical structure mainly do not occur periodically. For this reason, many methods for searching for melodic fragments are restricted to the individual finding of their occurrence. In contrast to this, interest in the field of rhythmical analysis is mainly directed to finding periodical structures.

In Meudic, B., "Musical Pattern Extraction: from Repetition to Musical Structure", in Proc. CMMR, 2003, http://www.ircam.fr/equipes/repmus/RMPapers/CMMR-meudic-2003.pdf, melodic patterns are identified with the help of a self-similarity matrix.

In Meek, Colin, Birmingham, W. P., "Thematic Extractor", ISMIR, 2001, http://ismir2001.ismir.net/pdf/meek.pdf, melodic themes are searched for. In particular, sequences are searched for, wherein the length of a sequence may be two notes up to a predetermined number.

In Smith, L., Medina, R. "Discovering Themes by Exact Pattern Matching", 2001, http://citeseer.ist.psu.edu/-498226.html, melodic themes with a self-similarity matrix are searched for.

In Lartillot, O., "Perception-Based Musical Pattern Discovery", in Proc. IFMC, 2003, http://www.ircam.fr/-equipes/repmus/lartillot/cmmr.pdf, also melodic themes are searched for.

In Brown, J. C., "Determination of the Meter of Musical Scores by Autocorrelation", J. of the Acoust, Soc. Of America, vol. 94, No. 4, 1993, from a symbolic representation of the musical signal, i.e. on the basis of an MIDI representation with the help of a periodicity function, the type of metric rhythm of the underlying piece of music is determined (autocorrelation function).

A similar proceeding is made in Meudic, B., "Automatic Meter Extraction from MIDI files", Proc. JIM, 2002, http:// www.ircam.fr/equipes/repmus/RMpapers/JIM-benoit2002-.pdf, where upon the estimation of periodicities a tempo and metric rhythm estimation of the audio signal is performed.

Methods for the identification of melodic themes are only restrictedly suitable for the identification of periodicities present in a tone signal, as musical themes are recurrent, however, as it has been discussed, do not, however, describe a basic periodicity in a piece of music but rather, if at all, contain higher periodicity information. In any case, methods for the identification of melodic themes are very expensive, as in the search for melodic themes the different variations of the themes have to be considered. Thus, it is known from the world of music that themes are usually varied, i.e. for example by transposition, mirroring, etc.

SUMMARY OF THE INVENTION

It is an object of the present invention to provide an efficient and reliable concept for characterizing a tone signal.

In accordance with a first aspect, the present invention provides a device for characterizing a tone signal, having a provider for providing a sequence of entry times of tones for at least one tone source; a processor for determining a common period length underlying the at least one tone source using the at least one sequence of entry times; a divider for dividing the at least one sequence of entry times into respective sub-sequences, wherein a length of a sub-sequence is equal to the common period length or derived from the common period length; and a combiner for combining the sub-sequences for the at least one tone source into one combined sub-sequence, wherein the combined sub-sequence is a characteristic for the tone signal.

In accordance with a second aspect, the present invention provides a method for characterizing a tone signal with the steps of providing a sequence of entry times of tones for at least one tone source; determining a common period length underlying the at least one tone source using the at least one sequence of entry times; dividing the at least one sequence of entry times into respective sub-sequences, wherein a length of a sub-sequence is equal to the common period length or is derived from the common period length; and combining the sub-sequences for the at least one tone source into one combined sub-sequence, wherein the combined sub-sequence represents a characteristic for the tone signal.

In accordance with a third aspect, the present invention provides a computer program having a program code for performing the method for characterizing a tone signal having the steps of providing a sequence of entry times of tones for at least one tone source; determining a common period length underlying the at least one tone source using the at least one sequence of entry times; dividing the at least one sequence of entry times into respective sub-sequences, wherein a length of a sub-sequence is equal to the common period length or is derived from the common period length; and combining the sub-sequences for the at least one tone source into one combined sub-sequence, wherein the combined sub-sequence represents a characteristic for the tone signal, when the computer program runs on a computer.

The present invention is based on the finding that an efficiently calculable and, with regard to many pieces of information, expressive characteristic of a tone signal may be determined on the basis of a sequence of entry times by period length determination, separation into sub-sequences and summary into a summarized sub-sequence as a characteristic.

Further, preferably not only one single sequence of entry times of a single instrument, i.e. of an individual tone source along the time is regarded, but rather at least two sequences of entry times of two different tone sources are regarded which occur in parallel in the piece of music. As it may typically be assumed that all tone sources or at least a subset of tone sources, like for example the percussive tone sources in a piece of music, have the same underlying period length, using the sequences of entry times of the two tone sources a common period length is determined which underlies the at least two tone sources. According to the invention, each sequence of entry times is then divided into respective sub-sequences, wherein a length of a sub-sequence is equal to the common period length.

The extraction of characteristics takes place on the basis of a combining of the sub-sequences for the first tone source into a first combined sub-sequence and on the basis of a combining of the sub-sequences for the second tone source into a second combined sub-sequence, wherein the combined sub-sequences serve as a characteristic for the tone signal and may be used for further processing, like for example for the extraction of semantically important information about the complete piece of music, like for example genre, tempo, type of metric rhythm, similarity to other pieces of music, etc.

The combined sub-sequence for the first tone source and the combined sub-sequence for the second tone source thus form a drum pattern of the tone signal when the two tone sources which were considered with regard to the sequence of entry times are percussive tone sources, like e.g. drums, other drum instruments or any other percussive instruments which distinguish themselves by the fact that not their tone pitch but their characteristic spectrum or the rising or falling of an output tone, respectively, and not the pitch, are of higher musical meaning.

The inventive proceeding therefore serves for an automatic extraction preferably of drum patterns from a preferably transcribed musical signal, i.e. for example the note representation of a musical signal. This representation may be in the MIDI format or be determined automatically from an audio signal by means of methods of digital signal processing, like for example using the independent component analysis (ICA) or certain variations of the same, like for example the non-negative independent component analysis or in general using concepts which are known under the keyword "blind source separation" (BSS).

In a preferred embodiment of the present invention, for the extraction of a drum pattern first of all a recognition of the note entries, i.e. the starting times per different instrument and per pitch in tonal instruments is performed. Alternatively, a readout of a note representation may be performed, wherein this readout may consist in reading in an MIDI file or in sampling and image-processing a musical notation or also in receiving manually entered notes.

Hereupon, in a preferred embodiment of the present invention, a raster is determined, according to which the note entry times are quantized, whereupon the note entry times are again quantized.

Hereupon, the length of the drum pattern is determined as the length of a musical bar, as an integral multiple of the length of a musical bar or as an integral multiple of the length of a musical counting time.

Hereupon, a determination of a frequency of the appearance of a certain instrument per metrical position is performed with a pattern histogram.

Then, a selection of the relevant entries is performed in order to finally obtain a form of the drum pattern as a preferred characteristic for the tone signal. Alternatively, the pattern histogram may be processed as such. The pattern histogram is also a compressed representation of a musical event, i.e. the note formation, and contains information about the degree of the variation and preferred counting times, wherein a flatness of the histogram indicates a strong variation, while a very "mountainous" histogram indicates a rather stationary signal in the sense of a self-similarity.

For improving the expressiveness of the histogram it is preferred to first perform a pre-processing in order to divide a signal into characteristically similar regions of the signal and to extract a drum pattern only for regions in the signal similar to each other and to determine another drum pattern for other characteristic regions within the signal.

The present invention is advantageous in so far that a robust and efficient way for calculating a characteristic of a tone signal is obtained, in particular on the basis of the performed division which may be performed, according to the period length which may be determined by statistical methods, also in a robust way and equal for all signals. Further, the inventive concept is scalable in so far that the expressiveness and accuracy of the concept, at the expense of a higher calculating time, however, may be easily increased by the fact that more and more sequences of occurrence times of more and more different tone sources, i.e. instruments, are included into the determination of the common period length and into the determination of the drum pattern, so that the calculation of the combined sub-sequences becomes more and more expensive.

An alternative scalability is, however, to calculate a certain number of combined sub-sequences for a certain number of tone sources, in order to then, depending on the interest in further processing, post-process the obtained combined sub-sequences and thus reduce the same with regard to their expressiveness as required. Histogram entries below a certain threshold value may for example be ignored. Histogram entries may, however, also be quantized as such or be binarized depending on the threshold value decision as to whether a histogram only still contains the statement that there is a histogram entry in the combined sub-sequence at a certain point of time or not.

The inventive concept is a robust method due to the fact that many sub-sequences are "merged" to a combined sub-sequence, which may be performed efficiently anyway, however, as no numerically intensive processing steps are required.

In particular, percussive instruments without pitch, in the following referred to as drums, play a substantial role, in particular in popular music. Many pieces of information about rhythm and musical genre are contained in the "notes" played by the drums, which could for example be used in an intelligent and intuitive search in music archives in order to be able to perform classifications or at least pre-classifications, respectively.

The notes played by drums frequently form repetitive patterns which are also referred to as drum patterns. A drum pattern may serve as a compressed representation of the played notes by extracting a note image of the length of a drum pattern from a longer note image. Thereby, from drum patterns semantically meaningful information about the complete piece of music may be extracted, like for example genre, tempo, type of metrical rhythm, similarity to other pieces of music, etc.

BRIEF DESCRIPTION OF THE DRAWINGS

In the following, preferred embodiments of the present invention are explained in more detail with reference to the accompanying drawings, in which.

DESCRIPTION OF THE PREFERRED EMBODIMENTS

Figure 1:
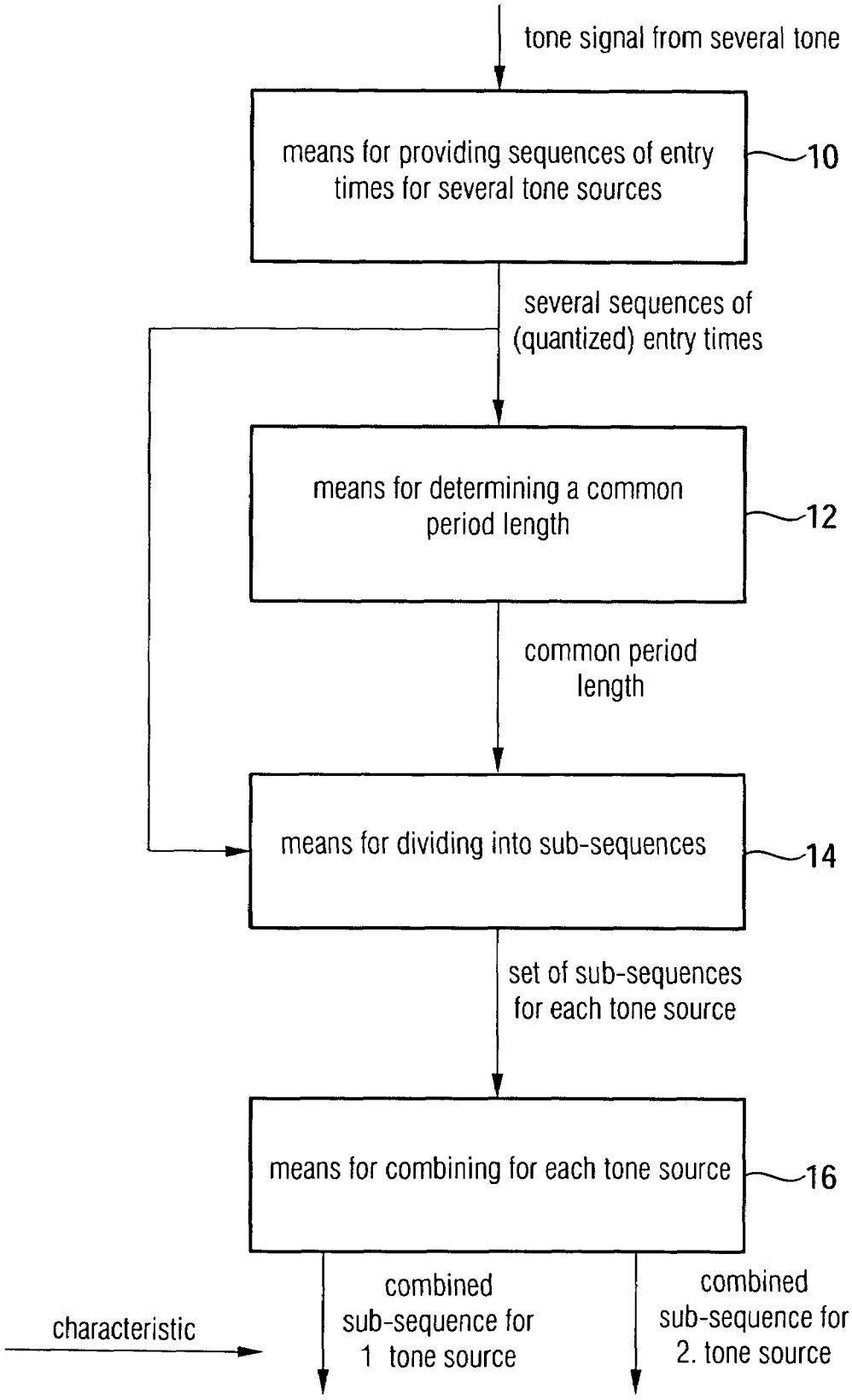
FIG. 1 shows a block diagram of an inventive device for characterizing a tone signal.
Figure 2:
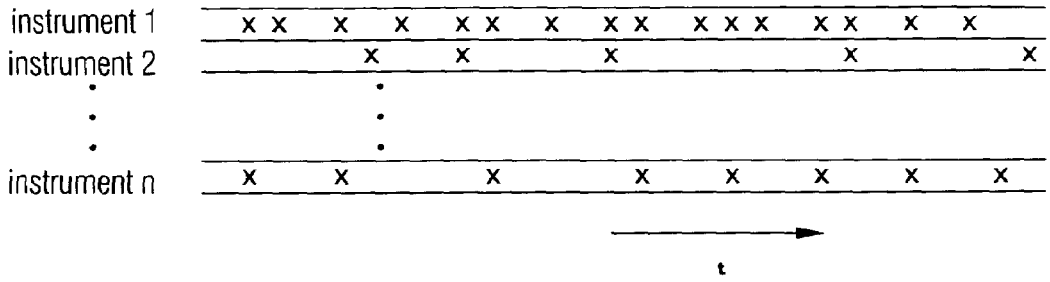
FIG. 2 shows a schematic illustration for explaining the determination of note entry points.

FIG. 1 shows an inventive device for characterizing a tone signal. Initially, FIG. 1 includes means 10 for providing a sequence of entry times for each tone source of at least two tone sources over time. Preferably, the entry times are already quantized entry times which are present in a quantization raster. While FIG. 2 shows a sequence of entry times of notes of different tone sources, i.e. instruments 1, 2, . . . , n indicated by "x" in FIG. 2, FIG. 3 shows a sequence of quantized entry times for each tone source quantized in a raster shown in FIG. 3, i.e. for each instrument 1, 2, . . . , n.

Figure 3:
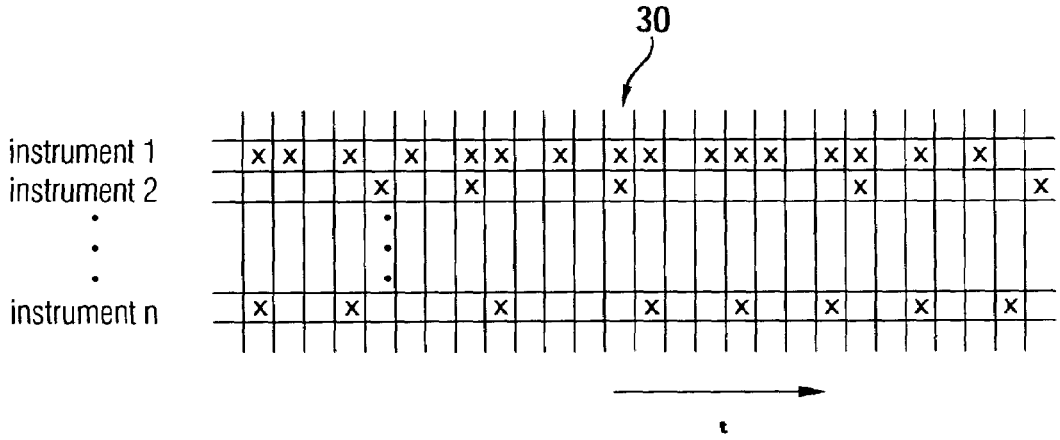
FIG. 3 shows a schematic diagram for representing a quantization raster and a quantization of the notes by using the raster.

FIG. 3 simultaneously shows a matrix or list of entry times, wherein a column in FIG. 3 represents a distance between two raster points or raster lines and thus a time interval in which, depending on the sequence of entry times, a note entry is present or not. In the embodiment shown in FIG. 3, for example in the column designated by the reference numeral 30, a note entry of instrument 1 is present, wherein this also applies for the instrument 2, as it is indicated by the "x" in the two lines associated with the two instruments 1 and 2 in FIG. 3. In contrast to that, the instrument n has no note entry time in the time interval shown by the reference numeral 30.

The several sequences of preferably quantized entry times are supplied from means 10 to a means 12 for determining a common period length. Means 12 for determining a common period length is implemented in order not to determine an individual period length for each sequence of entry times but to find a common period length that best underlies the at least two tone sources. This is based on the fact that even if for example several percussive instruments are playing in one piece, all more or less play the same rhythm, so that a common period length has to exist to which practically all instruments contributing to the tone signal, i.e. all sources, will adhere.

The common tone period length is hereupon supplied to means 14 for dividing each sequence of entry times, in order to obtain a set of sub-sequences for each tone source on the output side.

Figure 4:
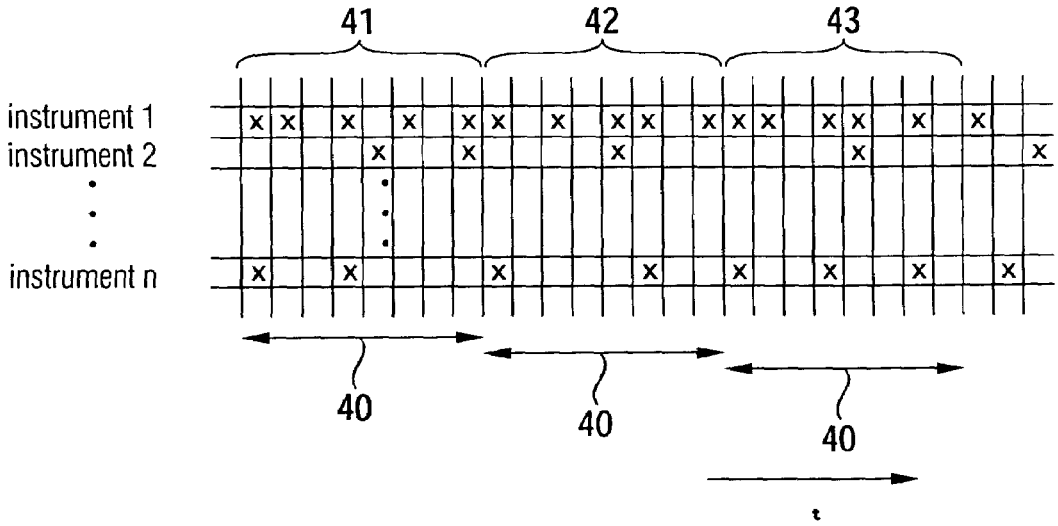
FIG. 4 shows an exemplary illustration of common period lengths which may be obtained by a statistical period length determination using any instruments.

If, for example, FIG. 4 is regarded, then it may be seen that a common period length 40 has been found, i.e. for any instruments 1, 2, . . . , n, wherein means 14 for dividing into sub-sequences is implemented in order to divide any sequences of entry times into sub-sequences of the length of the common period length 40. The sequence of entry times for the instrument would then, as it is shown in FIG. 4, be divided into a first sub-sequence 41, a subsequent second sub-sequence 42 and an again subsequent sub-sequence 43, in order to thus obtain three sub-sequences for the example shown in FIG. 4 for the sequence for the instrument 1. Similar to that, the other sequences for the instruments 2, . . . , n are also divided into corresponding adjacent sub-sequences, as it was illustrated with regard to the sequence of entry times for the instrument 1.

The sets of sub-sequences for the tone sources are then supplied to means 16 for combining for each tone source in order to obtain a combined sub-sequence for the first tone source and a combined sub-sequence for the second tone source as a characteristic for the tone signal. Preferably, the combining takes place in the form of a pattern histogram. The sub-sequences for the first instrument are laid on top of each other in an adjusted way to each other such that the first interval of each sub-sequence so to speak lies "above" the first interval of each other sub-sequence. Then, as it is shown with reference to FIG. 5, the entries in each slot of a combined sub-sequence or in each histogram bin of the pattern histogram, respectively, are counted. The combined sub-sequence for the first tone source would therefore be a first line 50 of the pattern histogram in the example shown in FIG. 5. For the second tone source, i.e. for example the instrument 2, the combined sub-sequence would be the second line 52 of the pattern histogram, etc. All in all, the pattern histogram in FIG. 5 thus represents the characteristic for the tone signal which may then again be used for diverse further purposes.

In the following, reference is made to different embodiments for the determination of the common period length in step 12. The finding of the pattern length may be realized in different ways, i.e. for example from an a priori criterion, which directly provides an estimation of the periodicity/pattern length based on the present note information, or alternatively e.g. by a preferably iterative search algorithm, which assumes a number of hypotheses for the pattern length and examines their plausibility using the resulting results. This may again for example be performed by the interpretation of a pattern histogram, as it is also for example implemented by means 16 for combining, or using other self-similarity measures.

Figure 5:
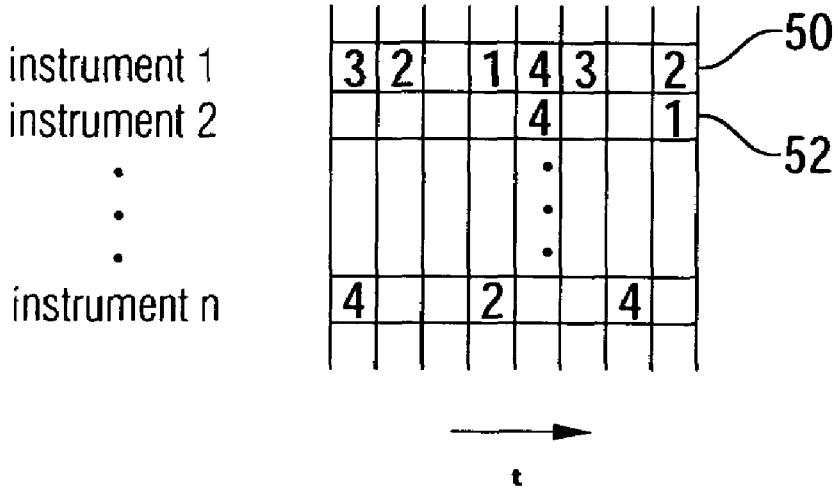
FIG. 5 shows an exemplary pattern histogram as an example for combined sub-sequences for the individual tone sources (instruments)

As it has been implemented, the pattern histogram, as it is shown in FIG. 5, may be generated by means 16 for combining. The pattern histogram may alternatively also consider the intensities of the individual notes in order to thus obtain a weighting of the notes according to their relevance. Alternatively, as it was shown in FIG. 5, the histogram may merely contain information as to whether in a sub-sequence or in a bin or a time slot of a sub-sequence a tone is present or not. Here, a weighting of the individual notes with regard to their relevance would not be included into the histogram.

Figure 6:
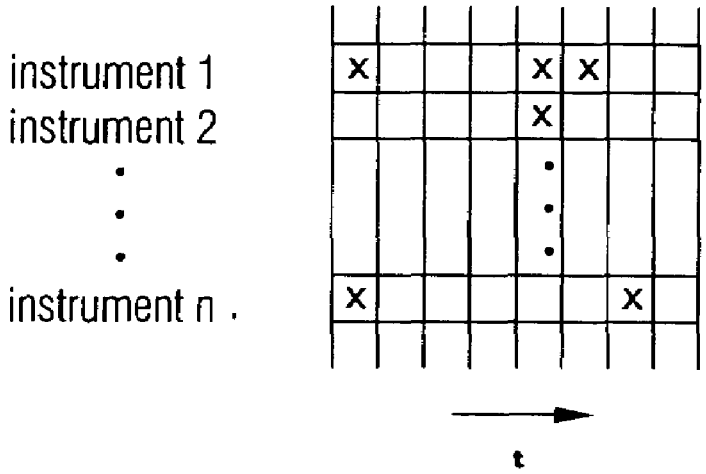
FIG. 6 shows a post-processed pattern histogram as an example for an alternative characteristic of the tone signal.

In a preferred embodiment of the present invention, the characteristic shown in FIG. 5, which is here preferably a pattern histogram, is processed further. In doing so, a note selection may be performed using a criterion, like for example by the comparison of the frequency or the combined intensity values to a threshold value. This threshold value may among other things also be dependent on the instrument type or the flatness of the histogram. The entries in drum patterns may be Boolean magnitudes, wherein a "1" would stand for the fact that a note occurs, while a "0" would stand for the fact that no note occurs. Alternatively, an entry in the histogram may also be a measure for how high the intensity (loudness) or the relevance of the notes occurring in this time slot is regarded across the music signal. When FIG. 6 is considered, then it may be seen that the threshold value was selected such that any time slots or bins, respectively, in the pattern histogram for each instrument were marked by an "x", in which the number of entries is greater than or equal to 3. In contrast to that, any bins are deleted in which the number of entries is smaller than 3, i.e. for example 2 or 1.

According to the invention, a musical "result" or score is generated from percussive instruments which are not or not significantly characterized by a pitch. The musical event is defined as the occurrence of a tone of a musical instrument. Preferably, only percussive instruments without a substantial pitch are regarded. Events are detected in the audio signal and classified into instrument classes, wherein the temporal positions of the events are quantized on a quantization raster which is also referred to as a tatum grid. Further, the musical measure or the length of a bar in milliseconds or, however, a number of quantization intervals is calculated, respectively, wherein further upbeats are also preferably identified. The identification of rhythmical structures on the basis of the frequency of the occurrence of musical events at certain positions in the drum pattern enables a robust identification of the tempo and gives valuable indications for the positioning of the bar lines if also musical background knowledge is used.

It is to be noted that the musical score or the characteristic, respectively, preferably includes the rhythmic information, like for example starting time and duration. Although the estimation of this metrical information, i.e. of a time signature, is not necessarily required for the automatic synthesis of the transcribed music, it is, however, required for the generation of a valid musical score and for the reproduction by human reproducers. Thus, an automatic transcription process may be separated into two tasks, i.e. the detection and the classification of the musical events, i.e. notes, and the generation of a musical score from the detected notes, i.e. the drum pattern, as it has already been explained above. To this end, preferably the metric structure of the music is estimated, wherein also a quantization of the temporal positions of the detected notes and a detection of upbeats and a determining of the position of the bar lines may be performed. In particular, the extraction of the musical score for percussive instruments without a significant pitch information of polyphonic musical audio signals is described. The detection and classification of the events is preferably performed using the method of independent subspace analysis.

An extension of the ICA is represented by the independent subspace analysis (ISA). Here, the components are divided into independent subspaces whose components do not have to be statistically independent. By a transformation of the musical signal a multi-dimensional representation of the mixed signal is determined and conformed to the last assumption for the ICA. Different methods for calculating the independent components were developed in the last years. Relevant literature that partially also deals with the analysis of audio signals is:

1. J. Karhunen, "Neural approaches to independent component analysis and source separation", Proceedings of the European Symposium on Artificial Neural Networks, pp. 249-266, Bruges, 1996.
2. M. A. Casey and A. Westner, "Separation of Mixed Audio Sources by Independent Subspace Analysis", Proceedings of the International Computer Music Conference, Berlin, 2000.
3. J.-F. Cardoso, "Multidimensional independent component analysis", Proceedings of ICASSP'98, Seattle, 1998.
4. A. Hyvärinen, P. O. Hoyer and M. Inki, "Topographic Independent analysis", Neural Computation, 13(7), pp. 1525-1558, 2001.

5. S. Dubnov, "Extracting Sound Objects by Independent Subspace Analysis" Proceedings of AES 22$^{nd}$ International Conference on Virtual, Synthetic and Entertainment Audio, Helsinki, 2002.
6. J.-F. Cardoso and A. Souloumiac, "Blind beamforming for non Gaussian signals" IEE Proceedings, Vol 140, No. 6, pp. 362-370, 1993.

An event is defined as the occurrence of a note of a musical instrument. The occurrence time of a note is also the point of time at which the note occurs in the piece of music. The audio signal is segmented into parts, wherein a segment of the audio signal has similar rhythmical characteristics. This is performed using a distance measure between short frames of the audio signal which is illustrated by a vector of audio features on a low level. The tatum grid and higher metrical levels are separately determined from the segmented parts. It is assumed that the metrical structure does not change within a segmented part of the audio signal. The detected events are preferably aligned with the estimated tatum grid. This process approximately corresponds to the known quantization function in conventional MIDI sequencer software programs for musical production. The bar length is estimated from the quantized event list and repetitive rhythmic structures are identified. The knowledge about the rhythmical structures is used for the correction of the estimated tempo and for the identification of the position of the bar lines using musical background knowledge.

In the following, reference is made to preferred implementations of different inventive elements. Preferably, means 10 performes a quantization for providing sequences of entry times for several tone sources. The detected events are preferably quantized in the tatum grid. The tatum grid is estimated using the note entry times of the detected events together with the note entry times that operate using conventional note entry detection methods. The generation of the tatum grid on the basis of the detected percussive events operates reliably and robustly. It is to be noted here, that the distance between two raster points in a piece of music usually represents the fastest played note. Thus, if in a piece of music at most sixteenth notes and no faster ones than the sixteenth notes occur, then the distance between two raster points of the tatum grid is equal to the time length of a sixteenth note of the tone signal.

In the general case, the distance between two raster points corresponds to the highest note value which is required in order to represent all occurring note values or temporal period lengths, respectively, by forming integral multiples of this note value. The raster distance is thus the highest common divisor of all occurring note durations/period lengths, etc.

In the following, two alternative approaches for determining the tatum grid are illustrated. First of all, as a first approach, the tatum grid is represented using a 2-way mismatch procedure (TWM). A series of experimental values for the tatum period, i.e. for the distance of two raster points, is derived from a histogram for an inter-onset interval (IOI). The calculation of the IOI is not restricted to successive onsets, but to virtually all pairs of onsets in a temporal frame. Tatum candidates are calculated as integer fractions of the most frequent IOI. The candidate is selected which predicts the harmonic structure of the IOI best according to the 2-way mismatch error function. The estimated tatum period is subsequently calculated by a calculation of the error function between the comb grid that is derived from the tatum period and the onset times of the signal. Thus, the histogram of the IOI is generated and smoothed by means of an FIR low-pass filter. Tatum candidates are also obtained by separating the IOI according to the peaks in the IOI histogram and by a set of values between e.g. 1 and 4. A rough estimation value for the tatum period is derived from the IOI histogram after the application of the TWM. Subsequently, the phase of the tatum grid and an exact estimation value of the tatum period are calculated using the TWM between the note entry times and several tatum grids with periods close to the previously estimated tatum period.

The second method refines and illustrates the tatum grid by calculating the best match between the note entry vector and the tatum grid, i.e. using a correlation coefficient $R_{xy}$ between the note entry vector x and the tatum y.

$$R_{xy} = \frac{\sum_{i=1}^{n} (x_i - \bar{x}) \cdot (y_i - \bar{y})}{\sqrt{\sum_{i=1}^{n} (x_i - \bar{x})^2 \sum_{i=1}^{n} (y_i - \bar{y})^2}}$$

In order to follow slight tempo variations, the tatum grid for adjacent frames is estimated e.g. with a length of 2.5 sec. The transitions between the tatum grids of adjacent frames are smoothed by low-pass filtering the IOI vector of the tatum grid points and the tatum grid is retrieved from the smoothed IOI vector. Subsequently, each event is associated with its closest grid position. Thereby, so to speak a quantization is performed.

The score may then be written as a matrix $T_{ik}$, i=1, . . . n and j=1, . . . , m, wherein n is the number of detected instruments and m equals the number of tatum grid elements, i.e. the number of columns of the matrix. The intensity of the detected events may either be removed or used, which leads to a Boolean matrix or a matrix with intensity values.

In the following, reference is made to special embodiments of means 12 for determining a common period length. The quantized representation of the percussive events provides valuable information for the estimation of the musical measure or a periodicity, respectively, underlying the playing of the tone sources. The periodicity on the metric rhythm level is for example determined in two stages. First, a periodicity is calculated in order to then estimate the bar length.

Preferably, as periodicity functions the autocorrelation function (ACF) or the average amount difference function (AMDF) are used, as they are represented in the following equations.

$$ACF(\tau) = \sum_{i=1}^{\tau} x_i x_{i+\tau}$$

$$AMDF(\tau) = \sum_{j=1}^{\tau} (x_j - x_{j+\tau})^2$$

The AMDF is also used for the estimation of the fundamental frequency for music and speech signals and for the estimation of the musical measure.

In the general case, a periodicity function measures the similarity or non-similarity, respectively, between the signal and its temporally different version. Different similarity measures are known. Thus, there is for example the hamming distance (HD) which calculates a non-similarity between two Boolean vectors $B_1$ and $B_2$ according to the following equation.

$$HD=\mathrm{sum}(b_1 \underline{v} b_2)$$

A suitable expansion for the comparison of the rhythmical structures results from the different weighting of similar hits and rests. The similarity B between two sections of a score $T_1$ and $T_2$ is then calculated by a weighted summation of the Boolean operations, as they are represented in the following.

$$B=a\cdot T_1 \hat{} T_2+b\cdot \hat{} \neg T_1 \neg T_2-c\cdot T_1 \underline{v} T_2$$

In the above equation the weights a, b and c are originally set to a=1, b=0.5 and c=0. a weights the occurrence of common notes, b weights the occurrence of common rests and c weights the occurrence of a difference, i.e. a note occurs in one score and in the other score no note occurs. The similarity measure M is obtained by the summation of the elements of B, as it is represented in the following.

$$M=\sum_{i=1}^{n}\sum_{j=1}^{m} B_{ij}$$

This similarity measure is similar to the hamming distance in so far that differences between matrix elements are considered in a similar way. In the following, as a distance measure a modified hamming distance (MHD) is used. In addition, the influence of distinctive instruments may be controlled using a weighting vector $v_i$, i=1, . . . , n, which is controlled either using a musical background knowledge, e.g. by putting more importance on small drums (snare drums) or on low instruments, or depending on the frequency and regularity of the occurrence of the instruments:

$$M_v=\sum_{i=1}^{n} v_i\cdot\sum_{j=1}^{m} B_{ij}$$

In addition, the similarity measures for Boolean matrices may be expanded by weighting B with the average value from $T_1$ and $T_2$ in order to consider intensity values. Distances or non-similarities, respectively, are regarded as negative similarities. The periodicity function P=f (M, 1) is calculated by calculating the similarity measure M between the score T and a shifted version of the same, wherein a shifting underlies 1. The time signature is determined by comparing P to a number of metrical models. The implemented metric models Q consist of a train of spikes in typical accent positions for different time signatures and micro-times. A micro-time is the integer ratio between the duration of a musical counting time, i.e. the note value determining the musical tempo (e.g. quarter note), and the duration of a tatum period.

The best match between P and Q is obtained when the correlation coefficient has its maximum. In the current state of the system 13 metric models for seven different time signatures are implemented.

Recurring structures are detected in order to detect e.g. upbeats and in order to obtain a robust tempo estimation. For the detection of drum patterns a score T is obtained from the length of a bar b by summation of the matrix elements T with a similar metric position according to the following equation:

$$T'=\sum_{k=1}^{p} T_{i,j+(k-1)b}$$

In the above equation b designates an estimated bar length and p the number of bars in T. In the following, T' is referred to as the score histogram or pattern histogram, respectively. Drum patterns are obtained from the score histogram T' by a search for score elements $T'_{i,j}$ with large histogram values. Patterns of a length of more than a bar are retrieved using a repetition of the above-described procedures for integer values of the measured length. The pattern length having the most hits, i.e. with regard to the pattern length itself, is selected in order to obtain a maximum representative pattern as a further or alternative characteristic for the tone signal.

Preferably, the identified rhythmic patterns are interpreted by use of a set of rules derived from musical knowledge. Preferably, equidistant events of the occurrence of individual instruments are identified and evaluated with reference to the instrument class. This leads to an identification of playing styles which often occur in popular music. One example is the very frequent use of the small drum (snare drum) or of tambourines or of hand claps in the second and fourth beat of a four-four time. This concept which is referred to as backbeat serves as an indicator for the position of the time lines. If a backbeat pattern is present a time starts between two beats of the small drum.

A further note for the positioning of the time lines is the occurrence of kick drum events, i.e. events of a large drum typically operated by the foot.

It is assumed that the start of a musical measure is marked by the metric position where most kick drum notes occur.

A preferred application of the characteristic as it is obtained by means 16 for combining for each tone source, as it is shown and described in FIG. 1, as it is e.g. illustrated in FIG. 5 or 6, consists in the genre classification of popular music. From the obtained drum patterns different features on a high level may be derived in order to identify typical playing styles. A classification procedure evaluates these features in connection with information about the musical measure, i.e. the speed, e.g. in beats per minute and using the used percussive instruments. The concept is based on the fact that any percussive instruments carry rhythm information and are frequently played repetitively. Drum patterns have genre-specific characteristics. Thus, these drum patterns may be used for a classification of the musical genre.

To this end, a classification of different playing styles is performed that are respectively associated with individual instruments. Thus, a playing style for example consists in the fact that events only occur on each quarter note. An associated instrument for this playing style is the kick drum, i.e. the big drum of the drums operated by the foot. This playing style is abbreviated by FS.

An alternative playing style is for example that events occur in each second and fourth quarter note of a four-four time. This is mainly played by the small drum (snare drum) and tambourines, i.e. the hand claps. This playing style is abbreviated as BS. Further exemplary playing styles consist in the fact that notes often occur on the first and the third note of a triplet. This is abbreviated as SP and is often observed in a hi-hat or a cymbal.

Therefore, playing styles are specific for different musical instruments. For example, the first feature FS is a Boolean value and true when kick drum events only occur on each quarter note. Only for certain values no Boolean variables are calculated, but certain numbers are determined, like for example for the relation between the number of off-beat events and the number of on-beat events, as they are for example played by a hi-hat, a shaker or a tambourine.

Typical combinations of drum instruments are classified into one of the different drum-set types, like for example rock, jazz, Latin, disco and techno, in order to obtain a further feature for the genre classification. The classification of the drum-set is not derived using the instrument tones but by the general examination of the occurrence of drum instruments in different pieces belonging to the individual genres. Thus, the drum-set type rock for example distinguishes itself by the fact that a kick drum, a snare drum, a hi-hat and a cymbal are used. In contrast to that, in the type "Latin" a bongo, a conga, claves and shaker are used.

A further set of features is derived from the rhythmical features of the drum score or drum pattern, respectively. These features include musical tempo, time signature, micro-time, etc. In addition a measure for the variation of the occurrence of kick drum notes is obtained by counting the number of different IOIs occurring in the drum pattern.

The classification of the musical genre using the drum pattern is performed with the use of a rule-based decision network. Possible genre candidates are rewarded when they fulfil a currently examined hypothesis and are "punished" when they do not fulfil aspects of a currently examined hypothesis. This process results in the selection of favorable feature combinations for each genre. The rules for a sensible decision are derived from observations of representative pieces and of the musical knowledge per se. Values for rewarding or punishing, respectively, are set empirically considering the robustness of the extraction concept. The resulting decision for a certain musical genre is taken for the genre candidate that comprises the maximum number of rewards. Thus, for example the genre disco is recognized when a drum-set type is disco, when the tempo is in a range between 115 and 132 bpm, when a time signature is 4/4 bits and the micro-time is equal to 2. Further, a further feature for the genre disco is that a playing style FS e.g. is present and that e.g. still one further playing style is present, i.e. that events occur on each off-beat position. Similar criteria may be set for other genres, like for example hip-hop, soul/funk, drum and bass, jazz/swing, rock/pop, heavy metal, Latin, waltzes, polka/punk or techno.

Depending on the conditions, the inventive method may be implemented for characterizing a tone signal in hardware or in software. The implementation may be performed on a digital storage medium, in particular a floppy disc or a CD with electronically readable control signals which may cooperate with a programmable computer system so that the method is performed. In general, the invention thus consists also in a computer program product having a program code stored on a machine-readable carrier for performing the method when the computer program product runs on a computer. In other words, the invention may thus be realized as a computer program having a program code for performing the method when the computer program runs on a computer.

While this invention has been described in terms of several preferred embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

What is claimed is:

1. A device for characterizing a tone signal, comprising:

a provider for providing a sequence of entry times of tones for at least one tone source;

a processor for determining a common period length underlying the at least one tone source using the at least one sequence of entry times;

a divider for dividing the at least one sequence of entry times into respective sub-sequences, wherein a length of a sub-sequence is equal to the common period length or derived from the common period length; and a combiner for combining the sub-sequences for the at least one tone source into one combined sub-sequence, wherein the combined sub-seguence is a characteristic for the tone signal.

2. The, device according to claim 1, wherein the provider for providing is implemented in order to provide at least two sequences of entry times for at least two tone sources, wherein the processor for determining is implemented in order to determine the common period length for the at least two tone sources, wherein the divider for dividing is implemented in order to divide the at least two sequences of entry times according to the common period length, and wherein the combiner for combining is implemented in order to combine the sub-sequences for the second tone source into a second combined sub-sequence, wherein the first combined sub-sequence and the second combined sub-sequence represent the charaoteristic for the tone signal.

3. The device according to claim 1, wherein the provider for providing is implemented in order to provide for each of the at least two tone sources one sequence of quantized entry times, wherein the entry times are quantized with regard to a quantization raster, wherein a raster point distance between two raster points is equal to a shortest distance between two tones in the tone signal or equal to the greatest common divisor of the duration of tones in the musical signal.

4. The device according to claim 1, wherein the provider for providing is implemented in order to provide the entry times of percussive instruments, but not the entry points of harmonic instruments.

5. The device according to claim 1, wherein the processor for determining is implemented to determine for each of a plurality of hypothetical common period lengths a probability measure, and to select the hypothetical common period length from the plurality of hypothetical common period lengths as a common period length whose probability measure indicates that the hypothetical common period length is the common period length for the at least two tone sources.

6. The device according to claim 5, wherein the processor for determining Is Implemented in order to determine the probability measure on the basis of a first probability measure for the first tone source and on the basis of a second probability measure for the second tone source.

7. The device according to claim 5, wherein the processor for determining is implemented in order to calculate the probability measures by a comparison of the sequence of entry points to a shifted sequence of entry points.

8. The device according to claim 1, wherein the divider for dividing is implemented to generate a list for each sub-sequence, wherein the list comprises an associated piece of information for each raster point and for each tone source, wherein the information relates to whether an entry point exists at a raster point or not.

9. The device according to claim 1, wherein the provider for providing is Implemented in order to generate a list for each tone source, wherein the list for each raster point of a raster comprises an associated piece of information whether there is an entry time of a tone at the raster point.

10. The device according to claim 1, wherein the combiner for combining is implemented in order to generate a histogram as a combined sub-sequence.

11. The device according to claim 10, wherein the combiner for combining is implemented to generate the histogram such that each raster point of a tone raster of the combined sub-sequence represents a histogram bin.

12. The device according to claim 10, wherein the combiner for combining is implemented to increment a count value for an associated bin in the histogram in each sub-sequence for a tone source when finding an input or by increasing the same by adding a measure determined by the input, wherein the input is a measure for the intensity of a tone that has an entry for the entry time.

13. The device according to claim 1, wherein the combiner for combining is implemented to output, in the first combined sub-sequence and the second combined sub-sequence, only values of the sub-sequences as a characteristic which are above the threshold.

14. The device according to claim 1, wherein the combiner for combining is implemented In order to normalize the sub-sequences with regard to the common length or to normalize the first combined sub-sequence or the second combined sub-sequence with regard to the common length.

15. The device according to claim 1, wherein the provider for providing is implemented in order to generate segments with a unique rhythmical structure from an audio signal, and wherein the combiner for combining is implemented in order to generate the characteristic for a segment having a unique rhythmical structure.

16. The device according to claim 1, further comprising:

an extractor for extracting a feature from the characteristic for the tone signal; and a processor for determining a musical genre to which the tone signal belongs, using the feature.

17. The device according to claim 16, wherein the processor for determining is implemented in order to use a rule-based decision network, a pattern recognizer means or a classifier.

18. The device according to claim 1, further comprising an extractor for extracting the tempo from the characteristic.

19. The device according to claim 18, wherein the extractor for extracting is implemented to determine the tempo on the basis of the common period length.

20. A method for characterizing a tone signal, comprising the following steps:

providing a sequence of entry times of tone for at least one tone source;

determining a common period length underlying the at least one tone source using the at least one sequence of entry times;

dividing the at least one sequence of entry times Into respective sub-sequences, wherein a length of a sub-sequence is equal to the common period length or is derived from the common period length; and combining the sub-sequences for the at least one tone source into one combined sub-sequence, wherein the combined sub-sequence represents a characteristic for the tone signal.

21. A computer program having a program code for performing the method for characterizing a tone signal, comprising the steps of:

providing a sequence of entry times of tones for at least one tone source;

determining a common period length underlying the at least one tone source using the at least one sequence of entry times;

dividing the at least one sequence of entry times into respective sub-sequences, wherein a length of a sub-sequence is equal to the common period length or is derived from the common period length; and combining the sub-sequences for the at least one tone source into one combined sub-sequence, wherein the combined sub-sequence represents a characteristic for the tone signal, when the computer program runs on a computer.

* * * * *